United States Patent [19]

Martin

[11] 4,368,044

[45] Jan. 11, 1983

[54] BOWLER'S APPROACH STARTING LOCATION CALCULATING DEVICE

[76] Inventor: James F. Martin, 3684 Mill St., Marion, N.Y. 14505

[21] Appl. No.: 340,054

[22] Filed: Jan. 18, 1982

[51] Int. Cl.[3] ..... A63B 69/00

[52] U.S. Cl. ..... 434/249; 235/70 R

[58] Field of Search ..... 235/70 R; 434/249

[56] References Cited

U.S. PATENT DOCUMENTS 2,498,421 2/1950 Hertig ..... 434/249 X 3,279,097 10/1966 Tomblin ..... 434/249

*Primary Examiner*—Harland G. Skogquist

*Attorney, Agent, or Firm*—Lawrence P. Kessler

[57] ABSTRACT

A calculating device for a bowling game whereby a bowler can readily ascertain an optimum approach starting location for throwing a bowling ball along a path which will maximize the number of pins knocked down. The calculating device comprises a first member having a first hairline and first and second indexes. The first index has indicia corresponding to bowling pin locations expressed in terms of distance from a given location, such as the marginal edge of a standard bowling lane. The second index has indicia corresponding to target marker locations expressed in terms of distance from the given location. A second member is slidably associated with the first member. The second member has a scale having indicia, corresponding to approach starting locations expressed in terms of distance from the given location, associated with the first hairline and second index. A cursor is slidably associated with the first and second members. The cursor has an indicator associated with the first index, and a second hairline associated with the scale. When the indicator is aligned with a particular bowling pin location on the first index, and when the second member is moved relative to the first member such that a particular portion of the scale associated with a particular portion of the scale associated with a particular target marker location is aligned with the second hairline, then an optimum approach starting location is found on the scale aligned with the first hairline.

7 Claims, 6 Drawing Figures

BOWLER'S APPROACH STARTING LOCATION CALCULATING DEVICE

BACKGROUND OF THE INVENTION

This invention relates to a calculating device for a bowling game whereby a bowler can readily ascertain an optimum approach starting location for throwing a bowling ball along a path which will maximize the number of pins knocked down.

One of today's most popular participant sports is bowling, in which the object is to throw a ball down a bowling lane and knock down pins located at the opposite end of the lane. The most common bowling games are ten-pins, duck-pins and candle-pins, with the differences between the games being that the shape and size of the pins and lane dimensions vary. Of these games, ten-pins is the most popular. The standard ten pin bowling lane is forty-two inches wide and sixty-three feet long, and has an approach portion extending sixteen feet from a foul line. The pins are located at the end of the lane in an equalateral triangle pattern, thrity-six inches on a side on twelve inch centers. The center of the head pin is sixty feet from the foul line. Target markers are located across the lane downstream of the foul line to assist in determining the path for the thrown ball.

Typically, the bowler chooses a starting position on the approach portion of the lane and selects a position relative to the target markers to align the path upon which to throw the ball toward the pins with the intent to maximize the number of pins to be knocked down. After throwing the ball, the bowler makes a visual assessment of the results of the ball path and adjusts the approach starting position and/or position relative to the target markers in an attempt to optimize the results of the ball path (i.e., maximize the number of pins knocked down). Such adjustment continues after each throw until the approach starting position and position relative to the target markers, for an ideal path, is attained. This trial-and-error path adjustment method is tedious and takes valuable time in finally arriving at such ideal path. Furthermore, if adjustment is necessary during the game, the ovrall score may be adversely effected until the ideal path is determined.

SUMMARY OF THE INVENTION

This invention relates to a calculating device for a bowling game whereby a bowler can readily ascertain an optimum approach starting location for throwing a bowling ball along a path which will maximize the number of pins knocked down. The calculating device comprises a first member having a first hairline and first and second indexes. The first index has indicia corresponding to bowling pin locations expressed in terms of distance from a given location, such as the marginal edge of a standard bowling lane. The second index has indicia corresponding to target marker locations expressed in terms of distance from the given location. A second member is slidably associated with the first member. The second member has a scale having indicia, corresponding to approach starting locations expressed in terms of distance from the given location, associated with the first hairline and second index. A cursor is slidably associated with the first and second members. The cursor has an indicator associated with the first index, and a second hairline associated with the scale. When the indicator is aligned with a particular bowling pin location on the first index, and when the second member is moved relative to the first member such that a particular portion of the scale associated with a particular portion of the scale associated with a particular target marker location is aligned with the second hairline, then an optimum approach starting location is found on the scale aligned with the first hairline.

This invention and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Referring now to the accompanying drawings, a calculating device for a bowling game, designated generally by the numeral 10, is shown for enabling a bowler to ascertain an optimum approach starting location in order to effectively throw a bowling ball along a path which will maximize the number of pins knocked down. The calculating device 10 will be described as being utilized in connection with a ten-pin bowling game. However, it is within the scope of this invention for the calculating device to be adapted for use in other types of bowling games, such as duck-pin or candle-pin bowling games.

Figure 1:
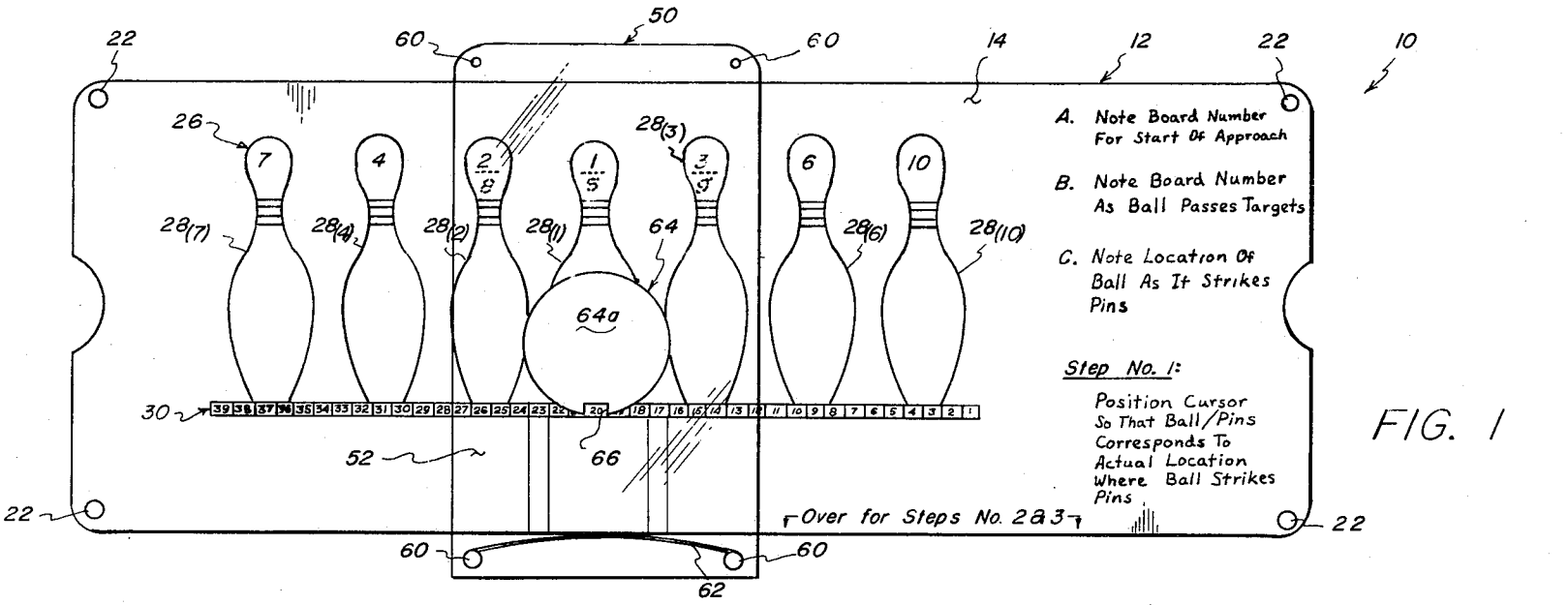
FIG. 1 is a side elevational view of one side of the calculating device according to this invention.
Figure 2:
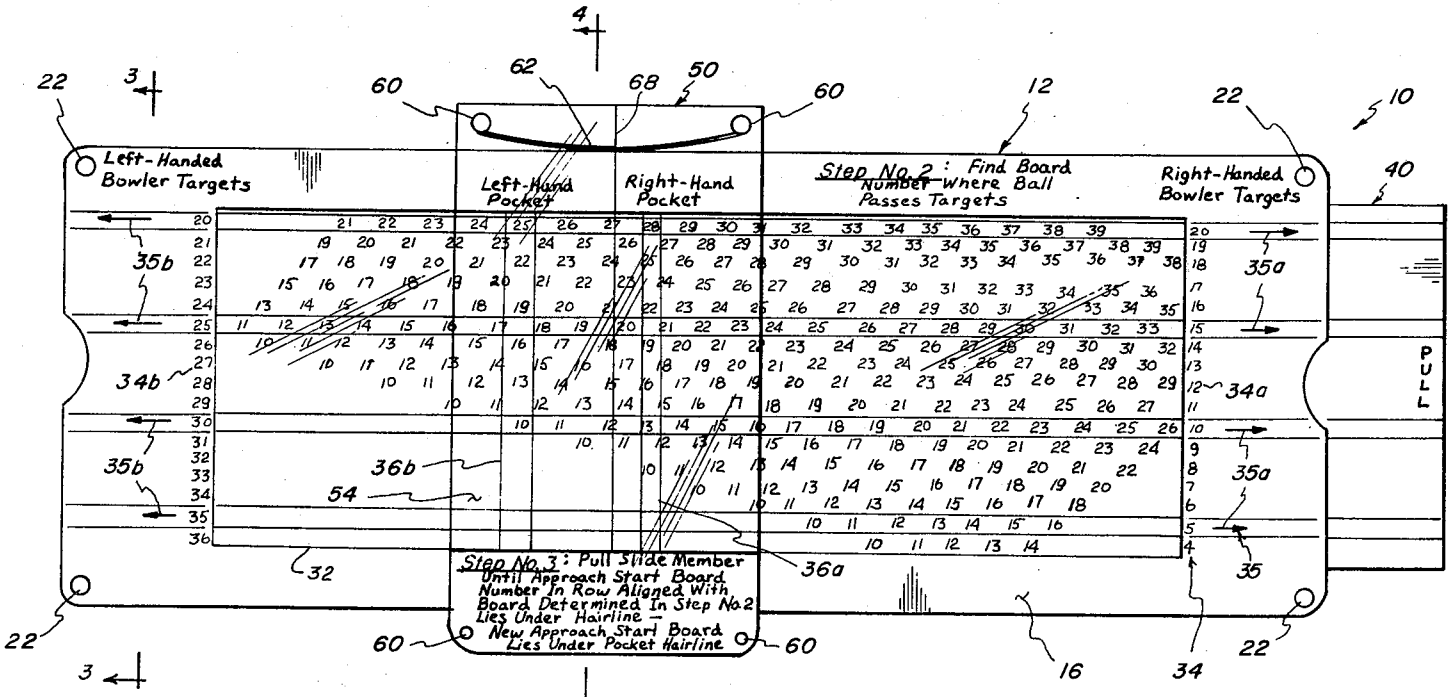
FIG. 2 is a side elevational view of the opposite side of the calculating device of FIG. 1.
Figure 3:
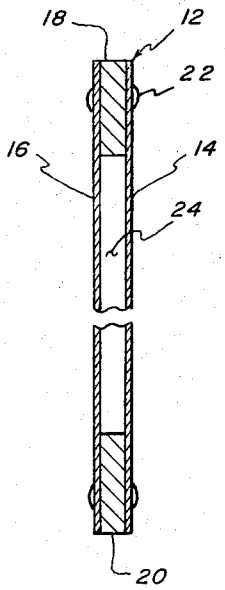
FIG. 3 is a view in cross-section of the calculating device taken along lines 3—3 of FIG. 2.

The calculating device 10 includes a body member 12 having a first side panel 14 (see FIG. 1) and an oppositely disposed second side panel 16 (see FIG. 2). The panels 14 and 16 are separated by spacer members 18 and 20 and are interconnected by conventional fasteners 22 to form an elongated chamber 24 (see FIG. 3). The first side panel 14 has a first index 26. The index 26 includes indicia in the form of a graphical representation of a front elevational view of a bowling pin setup on a standard ten-pin bowling lane. The individual pins $\mathbf{28}_{(1)}$ through $\mathbf{28}_{(10)}$ are located above a cross-section of the bowling lane 30, with the location expressed in terms of individual boards of the lane designated by numbers 1 through 39 starting from the right-hand marginal edge of the lane. Of course, the boards could be counted in alternative ways, such as from the left-hand marginal edge for example to simplify calculation for left-handed bowlers.

The second side panel 16 has a second index 34 located adjacent to the vertical marginal edges of such panel. The index 34 includes indicia representing the location of the target markers 35 on the standard ten-pen bowling lane expressed in terms of the individual boards of the lane, numbered in the corresponding manner to that shown in the lane 30 of the index 26. The indicia 34*a* of the index 34 adjacent to the right-hand vertical marginal edge, starting from the top of the panel 16, corresponds to the right-hand portion of the bowling lane from the center board (number 20) toward the right-hand edge of the lane with the target markers 35*a* shown as they would be located on the lane; and the indicia 34*b* of the index 34 adjacent to the left-hand vertical marginal edge, starting from the top of the panel 16, corresponds to the left-hand portion of the bowling lane from the center board (number 20) toward the left-hand edge of the lane with the target markers 35*b* shown as they would be located on the lane. The second side panel 16 also has a transparent portion 32 on which are scribed a first pair of double hairlines 36*a*, 36*b* oriented on vertical lines respectively aligned with particular ones of the boards in the representative lane 30 corresponding to the optimum locations at which the bowling ball should strike the pins.

Figure 5:
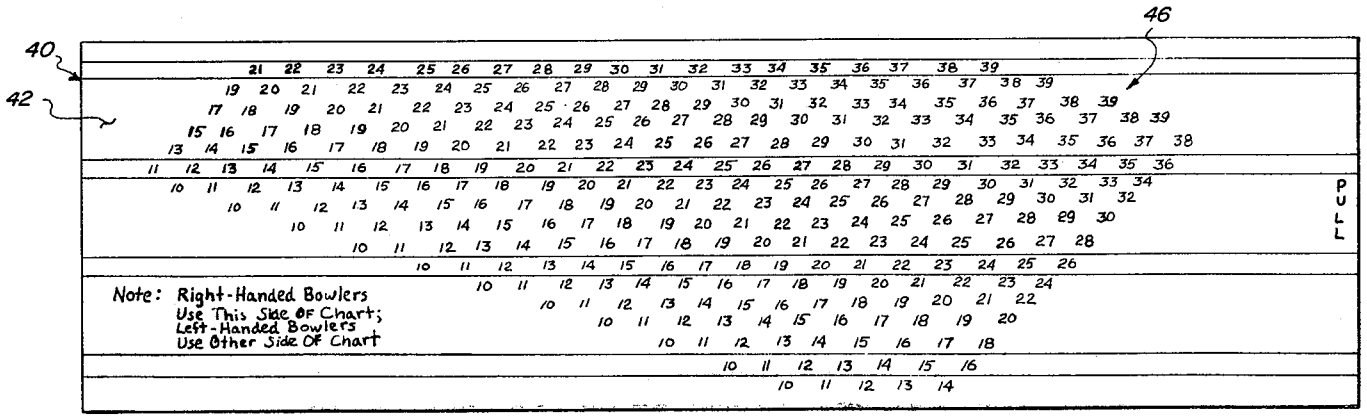
FIG. 5 is a side elevational view of one side of the slide member of the calculating device of this invention.
Figure 6:
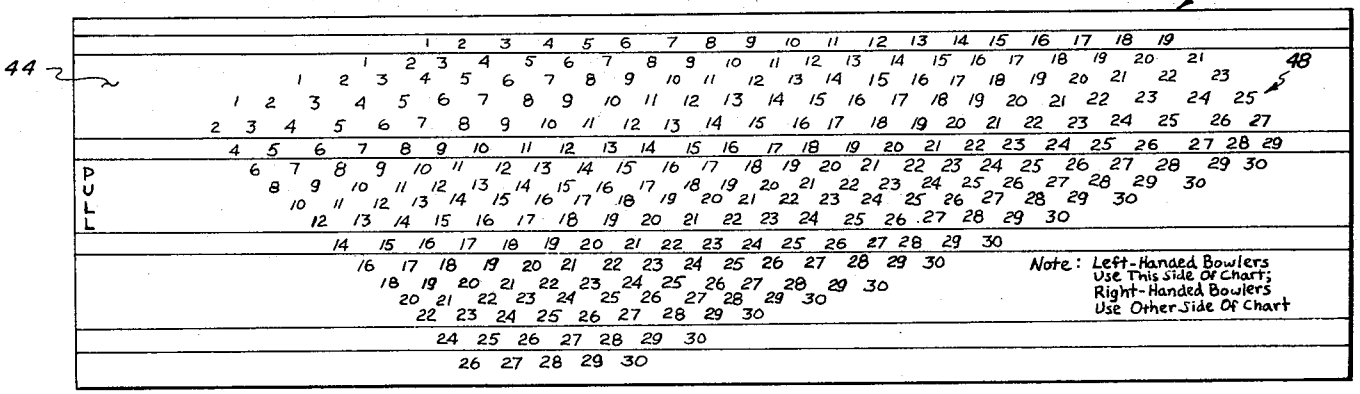
FIG. 6 is a side elevational view of the opposite side of the slide member of the calculating device of this invention.

A member 40 is slidably received in the elongated chamber 24. The member 40 has a first side panel 42 (see FIG. 5) and a second side panel 44 (see FIG. 6). The first side panel 42 has a scale 46. The scale 46 includes indicia corresponding to right-handed bowler's approach starting locations expressed in terms of the individual boards of the bowling lane, numbered in the corresponding manner to that shown in the representative lane 30 of the index 26. The second side panel 44 has a scale 48. The scale 48 includes indicia corresponding to left-handed bowler's approach starting locations expressed in terms of the individual boards of the bowling lane, numbered in the corresponding manner to that shown in the representative lane 30 of the index 26. The member 40 is inserted in the chamber 24 with the scale 46 showing through the transparent portion 32 of the second side panel 16 if the calculating device 10 is to be used by a right-handed bowler throwing a bowling ball with a normal trajectory path, or a left-handed bowler throwing a ball with an inverse trajectory path (commonly called a backup ball). Alternatively, the member 40 is inserted in the chamber 24 with the scale 48 showing through the portion if the device 10 is to be used by a left-handed bowler throwing a ball with a normal trajectory path, or a right-handed bowler throwing a ball with an inverse trajectory path.

Figure 4:
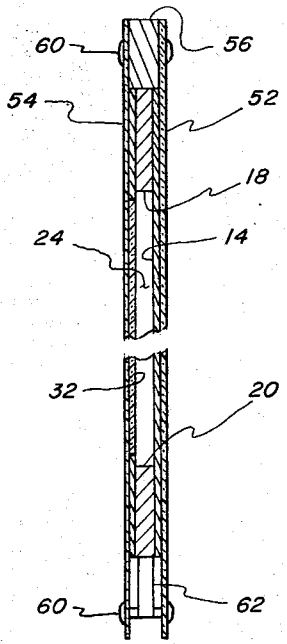
FIG. 4 is a view in cross-section of the calculating device taken along lines 4—4 of FIG. 2.

A cursor 50 is slidably mounted on the body member 12. The cursor 50 has a first side panel 52 (see FIG. 2) and a second side panel 54 (see FIG. 1), separated by a spacer members 56 and 58 (see FIG. 4), and interconnected by conventinal fasteners 60 such that panels 52 and 54 are respectively in light frictional engagement with panels 14 and 16 of the body member 12. A leaf spring 62, located between and connected to the panels 52 and 54, engages the body member 12 to urge the cursor into engagement with the body member. Thus, the cursor may slide relative to the body member and be maintained in any selected position along the body member. An indicator 64 is located on the first side panel 52 of the cursor 50. The indicator 64 is representative of a bowling ball 64*a* and has an opening 66 formed therein. The representative bowling ball 64*a* of the indicator 64 is aligned with the representation of the pins $28_{(1)}$–$28_{(10)}$ of the index 26, and the opening 66 is aligned with the representation of the bowling lane 30. Accordingly, by movement of the cursor 50 relative to the body member 12, when the bowling ball 64*a* of the indicator 64 is located relative to the pins $28_{(1)}$–$28_{(10)}$ so as to represent the actual location of a bowling ball striking a set of pins, the opening 66 overlies the particular one of the individual boards of the lane 30 at which the ball struck the pins. The cursor 50 also has a second double hairline 68, located vertically on the second side panel 54 and aligned with the opening 66 of the indicator 64. The hairline 68 overlies the scale 46 of the second side panel 16 of the body member 12 (showing through the transparent portion 32).

To use the calculator 10, a bowler lines up at a particular approach starting location. The bowling ball is thrown at the pins along a trajectory path which carries the ball over the lane past the target markers into the pins. The bowler notes the particularly selected approach starting location, the location of the thrown ball relative to the target markers, and the location of the ball relative to the pins as the ball first strikes the pins.

If the bowler is right-handed, he inserts the member 40 in the chamber 24 of the body member 12 with the first side panel 42 showing through the transparent portion 32. Looking at the first side panel 14 of the body member 12, he slides the cursor 50 along the body member until the representation of the bowling ball 64*a* overlies the representation of the pins $28_{(1)}$–$28_{(10)}$ so as to correspond to the actual location where the ball actually first struck the pins. The board number where the ball struck the pins shows at the opening 66. Then looking at the second side panel 16, he finds the board number corresponding to the location of the thrown ball relative to the target representation of the markers 35*a* in the right-hand index 34*a* of the index 34, he slides the member 40 until the board number corresponding to his approach starting location on the line of the scale 46 opposite the target marker board member lies between the double hairline 68 of the cursor 50. An optimum approach starting location can then be found between the double hairline 36*a* of the body member 12 on the same scale line. By starting his approach at such approach starting location shown by the calculating device 10, the thrown ball will have an optimum trajectory path for maximizing the number of pins knocked down. Alternatively, if the bowler is left-handed, the member 40 is inserted in the chamber 24 of the body member 12 with the scale 48 of the second side panel 44 showing through the portion 32, and the left-hand portion 34*b* of the index 34 is used. The optimum approach starting location can then be found between the double hairline 36*b* of the body member 12. In the example of FIGS. 1 and 2, the cursor 50 is set to illustrate a bowling ball thrown by a bowler which has struck the bowling pins at the head pin. Thus, as shown in FIG. 1, the representation of the bowling ball 64 overlies the representation of pin $28_{(1)}$. Assuming the bowler is right-handed, the approach starting location was at board number 18, and the ball trajector path passed the target markers at board number 14, the member 40 is moved until the number 18 on scale 46 aligned with board number 14 found on scale 34*a* lies under hairline 68 of side 54 of the cursor 50 (see FIG. 2). The proper approach starting location, found between the double hairlines 36*a*, is at board number 19. Of course, it is within the scope of this invention for the calculating device 10 to be electronic, with the scale 46 (48) being programmed into a microprocessor, for example, and accessed by digitally inputting the approach starting location, the location of the thrown ball relative to the target markers, and the location where the ball actually first strikes the pins.

This invention has been described in detail with particular reference to a preferred embodiment thereof, but it will be understood that variations and modifications can be effected within the spirit and scope of the invention.

I claim:

1. A bowling game calculating device for determining the optimum approach starting location of a bowler in a bowling game expressed as a distance from a given location on a standard bowling lane, said device comprising:

a first member, said first member having a first hairline thereon;

a first index on said first member, said first index having indicia corresponding to bowling pin locations expressed in terms of distance from a given location on a standard bowling lane;

a second index on said first member, said second index having indicia corresponding to target marker locations expressed in terms of distance from said given location on a standard bowling lane;

a second member associated with said first member for slidable movement relative thereto;

a scale on said second member, said scale having indicia corresponding to approach starting locations expressed in terms of distance from a given location on a standard bowling lane, said scale associated with said first hairline and said second index; and a cursor associated with said first and second members for slidable movement relative thereto, said cursor having an indicator and a second hairline thereon, said indicator associated with said first index and said second hairline associated with said scale; whereby when said indicator is aligned with a particular bowling pin location on said first index, and when said second member is moved relative to said first member such that a particular portion of said scale, associated with a particular target marker location of said second index, is aligned with said second hairline, then an optimum approach starting location is found on said scale aligned with said first hairline.

2. The invention of claim 1 wherein said standard bowling lane is comprised of a number of boards running the length thereof, and said first and second indexes and said scale are expressed as numbers corresponding to individual boards respectively designated from one marginal edge of said lane.

3. The invention of claim 1 wherein said second index has a first set of indicia expressed as distance from a given location adjacent the right-hand edge of a standard bowling lane and a second set of indicia expressed as distance from a given location adjacent the left-hand edge of a standard bowling lane; and wherein said scale has a first set of indicia associated with said first set of indicia of said second index and adapted to be utilized by right-hand bowlers, and a second set of indicia associated with said second set of indicia of said second index and adapted to be utilized by left-handed bowlers.

4. A calculating device for determining the optimum approach starting location of a bowler in a bowling game expressed as a board number from a marginal edge of a standard bowling lane, said device comprising:

a body member including first and second oppositely disposed side panels and means for spacing said first side panel from said second side panel to form a chamber therebetween; said first side panel having a first index including indicia corresponding to bowling pin locations expressed as board members from a marginal edge of a standard bowling lane; said second side panel having a second index including indicia corresponding to target marker location expressed as board numbers from said marginal edge, and a first hairline corresponding to the ideal location; where a bowling ball should strike the bowling pins;

a second member slidably received in said body member chamber, said second member having a scale, associated with said first hairline, including indicia corresponding to approach starting location expressed as board numbers from said marginal edge;

a cursor slidably mounted on said body member, said cursor including first and second oppositely disposed side panels; said first cursor side panel having an indicator overlying said first index, and said second cursor side panel having a second hairline aligned with said indicator and overlying said scale;

whereby when said indicator is aligned with a particular bowling pin location on said first index, and when said second member is slidably moved such that a particular portion of said scale, associated with a particular target marker location of said second index, is aligned with said second hairline, then an optimum approach starting location on said scale is aligned with said first hairline.

5. The invention of claim 4 wherein said indicia of first index includes a representation of a bowling pin setup on a cross-section of a standard bowling lane, and said indicator includes a representation of a bowling ball, adapted to overly said bowling pin setup representation, and an opening defined in said bowling ball representation, adapted to overly said representation of the cross-section of the standard bowling lane.

6. The invention of claim 4 wherein said second member includes first and second oppositely disposed side panels; and said scale has a first set of indicia on said first side panel of said second member adapted to be utilized by right-hand bowlers, and a second set of indicia on said second side panel of said second member adapted to be utilized by left-hand bowlers.

7. A bowling game calculating device for determining the optimum approach starting location of a bowler in a bowling game expressed as a distance from a given location on a standard bowling lane, said device comprising:

a scale having indicia corresponding to approach starting locations expressed in terms of distance from a given location on a standard bowling lane;

first means, associated with said scale, for indicating an approach starting location for the throwing of a bowling ball along a path toward a set of bowling pins, expressed in terms of distance from said given location;

second means, associated with said scale, for indicating the location of the path of the thrown ball relative to target markers on the standard bowling lane, expressed in terms of distance from said given location;

third means, associated with said scale, for indicating the location of where such thrown ball strikes the set of pins, expressed in terms of distance from said given location; and means for determining from said scale an optimum approach starting location when the approach starting location, the location of the path of the thrown ball relative to target markers, and the location of where such thrown ball strikes the pins are respectively indicated by said first, second and third means.

* * * * *